United States Patent [19]

Zinn

[11] Patent Number: 4,932,877

[45] Date of Patent: Jun. 12, 1990

[54] SPRING ARM CONTACT WITH OUTER SPRING

[75] Inventor: Bernd Zinn, Ennepetal, Fed. Rep. of Germany

[73] Assignee: Grote & Hartmann GmbH & Co. KG, Fed. Rep. of Germany

[21] Appl. No.: 395,022

[22] Filed: Aug. 16, 1989

[30] Foreign Application Priority Data

Aug. 31, 1988 [DE] Fed. Rep. of Germany ... 8811020[U]

[51] Int. Cl.[5] ..... H01R 11/22

[52] U.S. Cl. ..... 439/839

[58] Field of Search ..... 439/833, 839, 846

[56] References Cited

U.S. PATENT DOCUMENTS 4,412,718 11/1983 Pfister ..... 439/839
4,540,234 9/1985 Konnemann et al. ..... 439/839
4,540,235 9/1985 Lolic ..... 459/839

FOREIGN PATENT DOCUMENTS 3346322 7/1985 Fed. Rep. of Germany .
3502633 4/1986 Fed. Rep. of Germany .
8532580.5 9/1987 Fed. Rep. of Germany .

*Primary Examiner*—Joseph H. McGlynn
*Attorney, Agent, or Firm*—Jones, Askew & Lunsford

[57] ABSTRACT

This invention concerns a spring arm contact with an outer spring, possessing a conductor connection area, a spring arm base, and a contact area, with the contact area being formed by spring arms attached to the spring arm base and extending forward, and the outer spring being equipped with a spring arm base located on top of the spring arm base of the spring arm contact as well as with outer spring arms that embrace that spring arms of the spring arm contact from the outside, with a hexagonal hole being placed into the spring arm base of the spring arm contact, and the spring arm base of the outer spring being fitted with two dovetailed flaps located opposite each other which are bent into the interior of the spring arm base, with the shape of the flaps being adapted to the shape of the hole in such a manner that the side edges of the flaps grip behind the corresponding diagonal edges of the hole and lock into place.

9 Claims, 3 Drawing Sheets

SPRING ARM CONTACT WITH OUTER SPRING

The invention concerns a spring arm contact equipped with an outer spring, in particular a miniature flat spring arm contact (hereafter referred to as flat spring contact).

Such contacts are, for example, only 17.5 mm long and 2 mm thick. Therefore, it is difficult to mount an outer spring onto such a contact. Several clamping and retention elements or locking devices are necessary to position the outer spring on, for example, the flat spring contact in such a manner that it rests securely and firmly and ensures the required intensification of the flat spring contact's spring power. The variety of retention and locking elements makes assembly complex and considerably increases the cost of production of flat spring contacts with an outer spring.

It is the purpose of this invention to create a spring contact, in particular, a flat spring contact, with an outer spring, that requires only a few retention or locking elements which are easy to manufacture and easy to adjust during assembly.

This task is solved by means of the characteristics detailed in the primary claim. Further improved embodiments of the invention are described in the subclaims.

Figure 1:
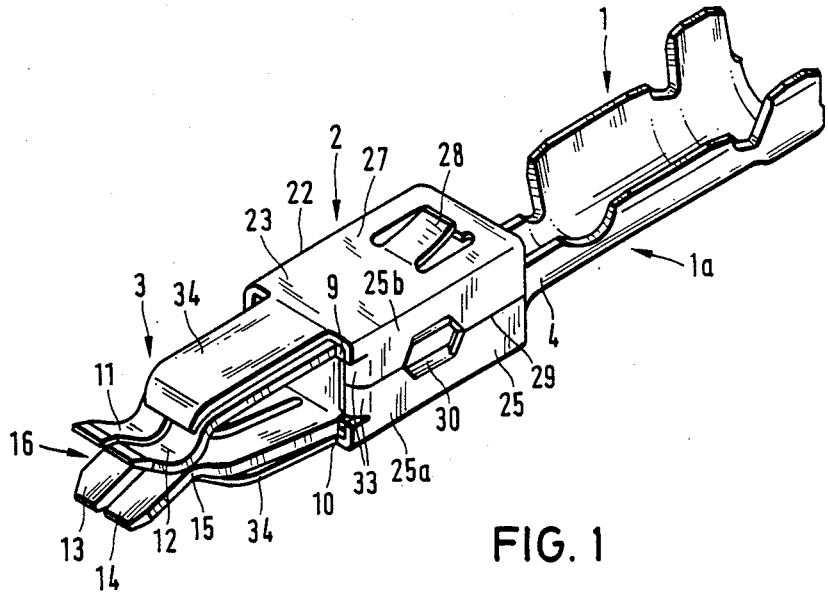
Figure 4:
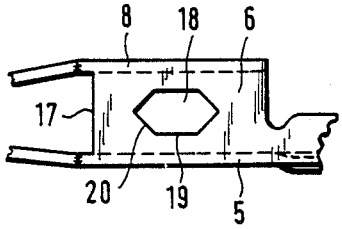
Figure 2:
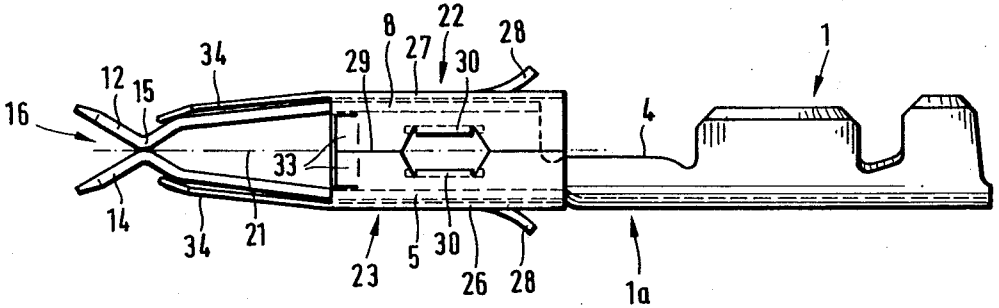
Figure 3:
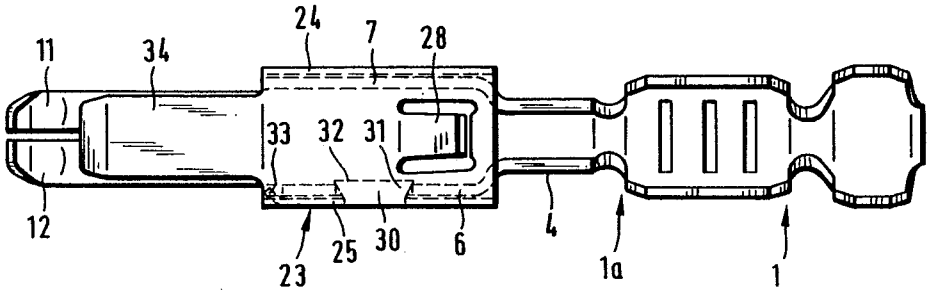
Figure 5:
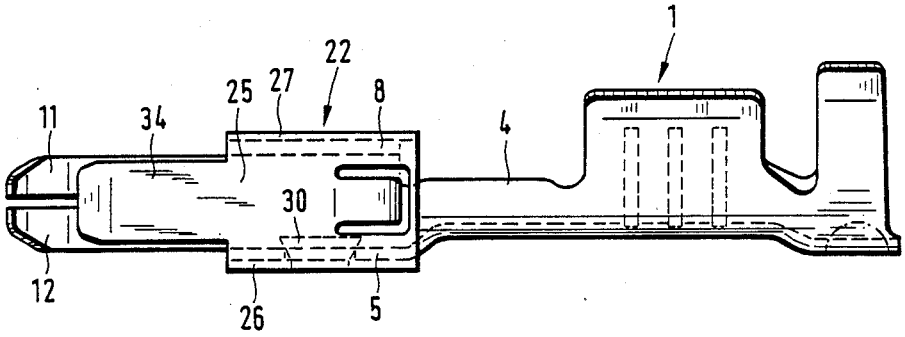
Figure 6:
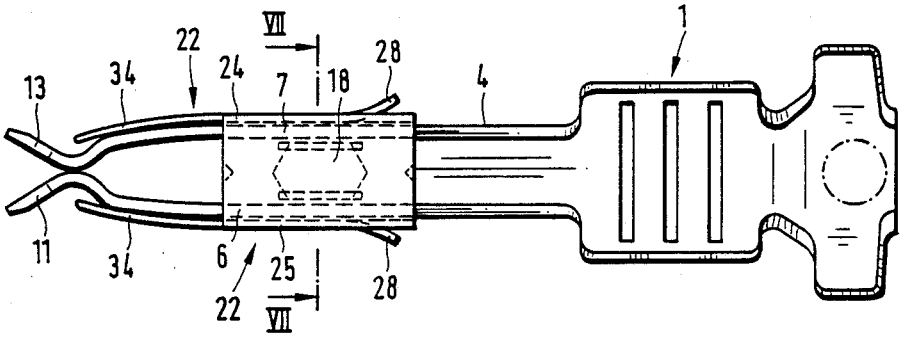
Figure 7:
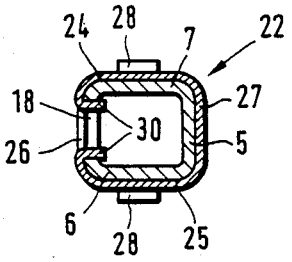

The invention is further explained using the figures. The figures show the following:

FIG. 1 a perspective top view of a flat spring contact,

FIG. 2 a side view of the flat spring contact,

FIG. 3 a top view of the flat spring contact,

FIG. 4 a partial side view of the spring arm base of the flat spring contact, FIG. 5 a side view of a different embodiment of the flat spring contact, FIG. 6 a top view of the flat spring contact according to FIG. 5, FIG. 7 a cross section along the line A-B of FIG. 6, facing the direction of the arrow.

The flat spring contact 1*a* made of one stamping is comprised of the crimp area 1, the spring arm base 2 and the contact area 3. The crimp area 1 corresponds to previously known embodiments and therefore does not require a more detailed description.

A box-shaped spring arm base 2 comprised of a bottom 5, two side walls 6 and 7, and a top 8 is connected to the crimp area 1 via a bridge 4 which, viewed in cross section, is roughly U- to V- shaped. The front edges 9 and 10 of the top 8 and the bottom 5, respectively, are each fitted with two longitudinally divided spring arms 11, 12 and 13, 14 respectively, extending forward, which run towards one another at an angle, touch in the line of contact 15, and, to form an insertion funnel 16, continue to diverge outward.

The front edge 17 in the side wall 6 is moved back slightly as compared to the front edges of the bottom 5 of the side wall 7 and the top 8 (FIG. 4). The purpose of this arrangement will be discussed at a later point.

A hole 18, whose shape is essential, is implemented in the side wall 6, preferably in the center (FIG. 4). The hole 18 is hexagonal in shape and is comprised of two longitudinal edges 19 of equal length and four diagonal edges 20 of equal length, with the longitudinal edges 19 being longer than the diagonal edges 20. The longitudinal edges 19 run longitudinally along the spring arm base 2, preferably parallel to the longitudinal axis 21 of the spring arm base 2.

The outer spring 22 manufactured from one stamping is mounted flush on the flat spring contact 1*a* in a known configuration. The sheet metal used for the outer spring 22 is thinner than the sheet metal used for the flat spring contact 1*a*, but the material of which the outer spring 22 is made has a greater spring power that the material used for the flat spring contact 1*a*. The outer spring 22 also possesses a box-shaped spring arm base 23 equipped with two side walls 24 and 25, a bottom 26, and a top 27, with outer spring arms 34, which extend forward and embrace the spring arms 11, 12, 13, and 14 of the flat spring contact 1*a*, being connected to the bottom 26 and the top 27. Detent spring tongues 28 that extend backward and outward are fitted into the bottom 26 and the top 27 in a known manner, each by means of a U-shaped cutout.

The board of the outer spring 22 (not illustrated) is cut in such a fashion that the joining edges 29 of the spring arm base 23 are arranged in the longitudinal center of the side wall 6 of the spring arm base 2 of the flat spring contact 1*a*. Extending from each joining edge 29, oppositely located dovetailed flaps 30, each with two side edges 31 and one longitudinal edge 32, are inserted into the side wall parts 25*a* and 25*b* flush with the hole 18 in the side wall 6. The flaps 30 are bent into the interior of the spring arm base 2, with the shape of the flaps being adapted to the shape of the hole 18 in such a manner that the side edges 31 of the flaps 30 grip behind the corresponding diagonal edges 20 of the hole 18 and lock into place. This results, through simple means, in a very efficient retention, or locking into place, of the outer spring 22 in the spring arm base 2 of the flat spring contact 1*a*.

It may be useful to insert flaps 23, at the front edge of the side wall parts 25*a* and 25*b*, parallel to the joining edges 29, and to bend them against the front edge 17 of the side wall 6 of the spring arm base 2 of the flat spring contact 1*a*, which results in a particularly secure retention of the outer spring 22 on the flat spring contact 1*a*.

The invention has been illustrated above, using as an example a box-shaped flat spring contact. The retention, or locking into place, proposed by the invention, can be realized equally efficiently through a differently shaped contact or spring arm base, for example, a round spring arm base. It is also irrelevant where the hole 18 is located; it may be placed on the bottom or the top rather than in a side wall. It should, however, be positioned in a location where there are no joining edges of the contact's spring arm base. As a preferred example, FIGS. 5 and 6 show the attachment of the spring arms 11, 12, and 13, 14 to the side walls 6 and 7, with the joining edges of the spring arm base 2 being located in the top 8 and the hole 18 being located in the bottom 5. The outer spring 22 is adapted correspondingly, such that the joining edges 29 of the outer spring 22 are located in the wall opposite the wall of the spring arm base 2 where the joining edges of the spring arm base 2 are located. With this embodiment of the invention, the top 8 of the spring arm base 2 may even be absent, and the spring arm base 2 may be U-shaped. Here, the detent spring arms 28 are mounted preferably to the side wall 24, 25. The edge 17, moved back due to the cutout, and the retention flaps 33 may be absent (FIGS. 5 through 7).

The special shape of the hole 18, a hexagon with diagonal edges 20, and the shape, adapted correspondingly, of the dovetailed flaps 30 with the side edges 31 result not only in the secure retention of the outer spring 22 on the spring arm base 2, but also in the locking into place of the outer spring 22, such that the joining edges 29 of the outer spring 22 are prevented from opening; thus, the spring power of the spring arms 34 of the outer spring 22 does not change and does not become adversely affected when the joining edges 29 are pried apart.

I claim:

1. Spring arm contact with outer spring, possessing a conductor connection area, a spring arm base, and a contact area, with the contact area being formed by spring arms attached to the spring arm base and extending forward, and the outer spring being equipped Q with a spring arm base located on top of the spring arm base of the spring arm contact as well as with outer spring arms that embrace the spring arms of the spring arm contact from the outside, characterized by the fact that a hexagonal hole (18) is placed into the spring arm base (2) of the spring arm contact (1*a*), and that the spring arm base (23) of the outer spring (22) is fitted with two dovetailed flaps (30) located opposite each other which are bent into the interior of the spring arm base (2), with the shape of the flaps being adapted to the shape of the hole (18) such that the side edges (31) of the flaps (30) grip behind the corresponding diagonal edges (20) of the hole (18) and lock into place.

2. Contact arm spring designed as a flat spring contact according to claim 1, characterized by a box-shaped spring arm base (2) with a bottom (5), two side walls (6 and 7), and a top (8), with the front edge (9 and 10, respectively) of the top (8) and the bottom (5) each being fitted with two longitudinally divided spring arms (11, 12 and 13, 14) that extend forward, running toward each other at an angle, touching in a line of contact (15) and, to form an insertion funnel (16) continuing to diverge outward.

3. Flat spring contact according to claim 2, characterized by the fact that the hole (18) is located in the side wall (6), possesses two longitudinal edges (19) of equal length and four diagonal edges (20) of equal length, and that the longitudinal edges (19) are longer than the diagonal edges (20), with the longitudinal edges (19) running longitudinally along the spring arm base (2), preferably parallel to the longitudinal axis (21) of the spring arm base (2).

4. Flat spring contact according to claim 2 or 3, characterized by the fact that the outer spring (22) is also equipped with a box-shaped spring arm base (23) with two side walls (24, 25), a bottom (26), and a top (27), with two outer spring arms (34) that extend forward being connected to the bottom (26) and the top (27) and embracing the spring arms (11, 12 and 13, 14) of the flat spring contact (1*a*) from the outside.

5. Flat spring contact according to claim 4, characterized by the fact that detent spring tongues (28) are inserted into the bottom (26) and the top (27) by means of a U-shaped cutout and that they extend outward.

6. Flat spring contact according to claim 4, characterized by the fact that the joining edges (29) of the spring arm base (23) are located in the longitudinal center of the side wall (6) of the spring arm base (2) of the flat spring contact (1*a*) and that the dovetailed flaps (30) extend from each joining edge (29) and possess two side edges (31) and one longitudinal edge (32).

7. Flat spring contact according to claim 4, characterized by the fact that the side edges (31) of the flaps (30) grip behind the diagonal edges (20) of the hole (18).

8. Flat spring contact according to claim 2, characterized by the fact that the front edge (17) in the side wall (6) is moved back slightly as compared to the front edges of the bottom (5) of the side wall (7) and the top (8), that at the front edge of the side wall parts (25*a*, 25*b*) of the side wall (25) divided by the joining edges (29), flaps (23) are inserted parallel to the joining edges (29), and that these flaps are bent toward the front edge (17) of the side wall (6) of the spring arm base (2).

9. Flat spring contact according to claim 2, characterized by the fact that the spring arms (11, 12 and 13, 14) are attached to the side walls (6, 7), with the joining edges (29) of the spring arm base (2) being located at the top (8) and the hole (18) being located at the bottom (5), and the outer spring being shaped and arranged correspondingly such that the joining edges (29) of the outer spring (22) are located in the wall opposite the wall of the spring arm base (2) where the joining edges of the spring arm base (2) are located, and with the detent spring arms (28) being mounted to the side walls (24, 25).

* * * * *

UNITED STATES PATENT AND TRADEMARK OFFICE

CERTIFICATE OF CORRECTION

PATENT NO. : 4,932,877

DATED : June 12, 1990

INVENTOR(S) : Bernd Zinn

It is certified that error appears in the above-identified patent and that said Letters Patent is hereby corrected as shown below:

In Claim 1, line 5 (column 3, line 14), cancel "Q".

Signed and Sealed this

Twenty-first Day of April, 1992

*Attest:*

HARRY F. MANBECK, JR.

*Attesting Officer*

*Commissioner of Patents and Trademarks*